United States Patent [19]

Ionel

[11] 4,076,236

[45] Feb. 28, 1978

[54] BAR-BELL TYPE EXERCISING DEVICE

[76] Inventor: Stefan Ionel, 14, rue Michel Servet, 1206 - Geneva, Switzerland

[21] Appl. No.: 650,984

[22] Filed: Jan. 21, 1976

[30] Foreign Application Priority Data

Jan. 21, 1975 Switzerland ..... 693/75

[51] Int. Cl.[2] ..... A63B 11/00

[52] U.S. Cl. ..... 272/123

[58] Field of Search ..... 272/122, 123, 124

[56] References Cited

U.S. PATENT DOCUMENTS

| | | | |
|---|---|---|---|
| 983,372 | 2/1911 | Johnson | 272/123 |
| 1,019,584 | 3/1912 | Balston | 272/122 |
| 1,536,048 | 5/1925 | Alastalo | 272/122 |
| 2,644,890 | 7/1953 | Hollihan | 272/122 |

*Primary Examiner*—Richard T. Stouffer
*Assistant Examiner*—William R. Browne
*Attorney, Agent, or Firm*—Young & Thompson

[57] ABSTRACT

The invention relates to a hantel easy to transport and store and the weight of which can be adapted at will. This hantle comprises a handle and at least two hollow bodies each connected, in a removable way, to one end of said handle. A plug closes tightly each hollow body which may be filled with water or other materials for use.

6 Claims, 3 Drawing Figures

BAR-BELL TYPE EXERCISING DEVICE

Figure 1:
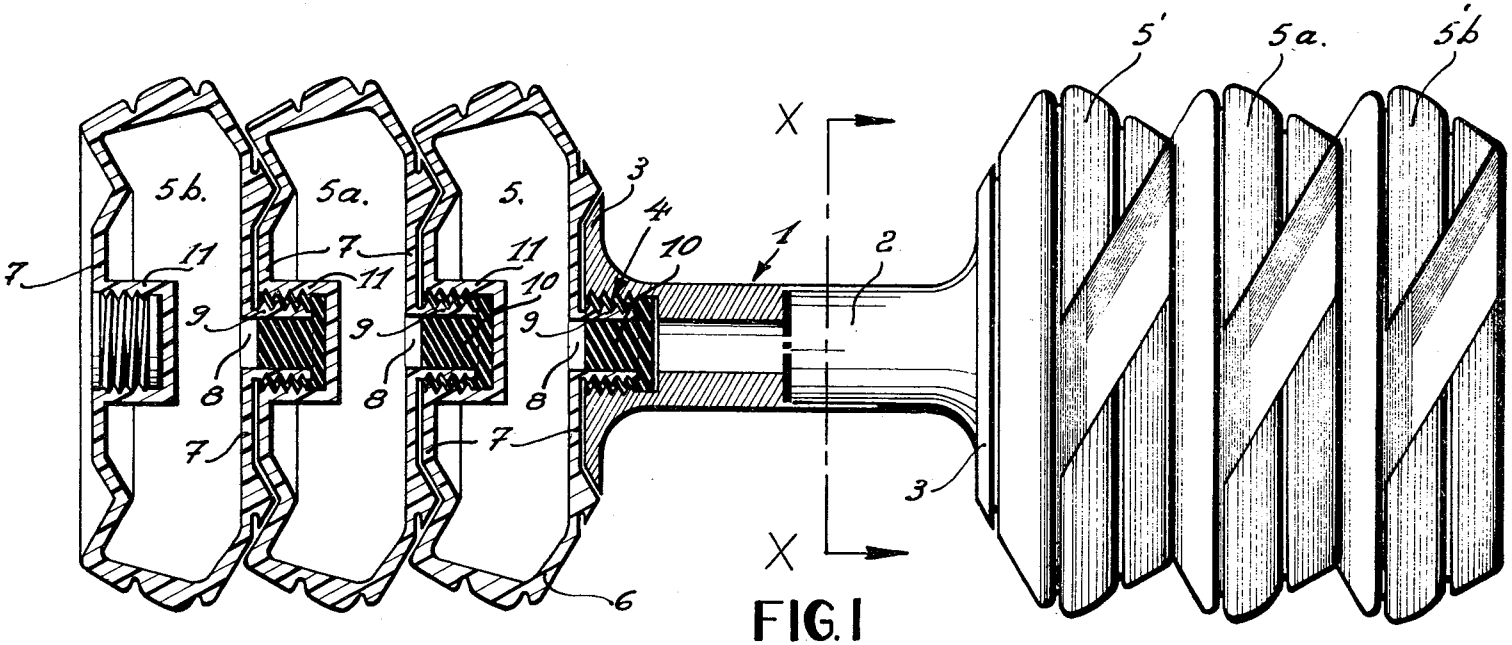

The present invention relates to a hantel for persons taking physical training or education.

The existing hantels are heavy, cumbersome and of a very high cost.

On the other hand, it is necessary to possess several hantels of different weight since their weight is not adjustable.

The hantel according to the present invention tends to remedy the precited drawbacks and distinguishes itself by the fact that it comprises a handle and at least two hollow bodies each removably connected to one end of the handle.

The attached figures of the drawing show schematically and by way of example preferred embodiments of the hantel according to the invention.

Figure 2:
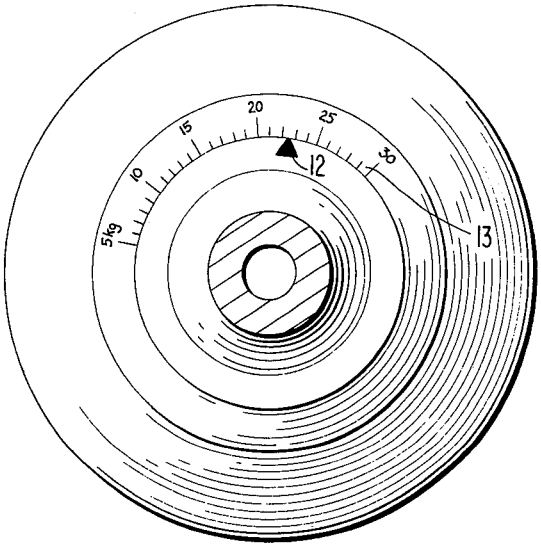
Figure 3:
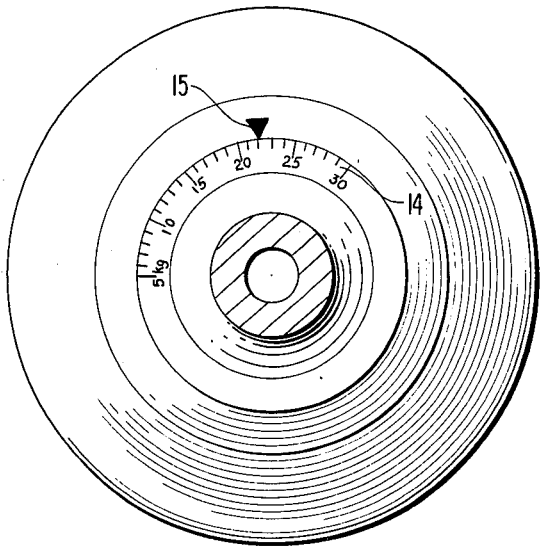

In the drawings, FIG. 1 shows a view of a hantel according to the present invention, partly in section;

FIG. 2 is a cross-sectional view taken on the line X—X in FIG. 1, showing one embodiment of index and graduation for indicating the weight of the hantel; and FIG. 3 is a view similar to FIG. 2 but showing another embodiment of the index and graduation.

The hantel shown comprises a handle 1, made of rigid plastic material, and which has in this embodiment a hollow portion along its longitudinal axis.

This handle 1 comprises a central portion 2 having a general cylindrical shape but which can be adapted anatomically to the shape of the hand of the user. It is by this center portion 2 that the user takes the hantel.

Each end of the handle comprises a disc 3 as well as one part of a coupling device, here tapping 4.

The hantel shown comprises further pairs of hollow bodies 5,5', here three pairs which can be connected either directly to the handle or between themselves.

Each hollow body 5 is identical and comprises an envelope 6 the outside shape of which is choosen as a function of the aesthetical appearance which one desires to give to the hantel. The lateral walls 7 of the hollow bodies comprise outside surfaces the shape of which corresponds to the outside surface of the disc 3 of the handle in order to fit against it in service position. The wall 7 turned towards the handle 1 comprises a central aperture 8 surrounded by a tubular skirt 9 the outside wall of which comprises a threading.

A plug 10 closes this aperture and comprises an outside skirt, internally threaded as well as externally. Therefore, the plug 10 may be threaded into service position on the tubular skirt 9 to close the hollow body 5. Furthermore, the pitch of the outside threading of the plug corresponds to that of the tapping 4 of the handle 1. The hollow body 5 which is closed may thus be threaded in the end of the handle into service position.

The other wall 7, looking to the other side of the handle, comprises a cylindrical recessed formation, extending within the hollow body 5 which is provided with an internal tapping presenting the same characteristics as the tapping 4 of the handle. Thanks to this tapped formation 11, it is possible to connect a second hollow body **5*a* or even a third one 5*b* each to the others to obtain a hantel of different weight Each hollow body 5 is constituted, as well as the plug 10, by a plastic material which is relatively supple with respect to that of the handle 1. This permits to damp the shocks when the hantel falls and also to insure a good tightness of the plug 10 and a sufficient strength of the coupling of the hollow bodies 5** to the handle and between themselves.

All the hollow bodies being indentical, as well as all the plugs, only three moulds are necessary to manufacture the hantel which permit to lower its production cost. This cost is also maintained at a low level due to the small quantity of plastic material used for its manufacture.

Finally a great advantage resides in the low weight of the hantel which may be easily transported for example during travel. Once it is dismounted the hantel is not cumbersome at all and may be placed easily in ones luggage.

This lightness of the hantel is not a handicap during training. As a matter of fact, in service position the hollow bodies 5 may be filled with water, so that for a volume of the order 200 cc of each hollow body, the weight of the hantel may be modified in increments of 400 gr through the adjunction of supplemental pairs of hollow bodies. One may thus realize a weight-scale of, for example, 100, 500, 1000, 15000 grams.

By replacing the water contained in the hollow bodies with sand or iron balls, it is possible to still further increase the weight of the hantel up to a total weight of about 8 to 10 kilograms for three pairs of hollow bodies having a cavity of 200cc.

There is thus provided a dismantable hantel which is not cumbersome and which is light for its transport and the weight of which in use is adaptable at will.

It is evident that the shape of the handle and of the hollow body may vary within wide limits, these shapes are only dependant aesthetical considerations.

Finally, it is evident that the coupling of the hollow bodies between themselves and to the handle could be differently realized, for example by a bayonet coupling or by a coupling of the press button type.

It is evident that at least the handle could be realized in other materials. For example, the handle could be made out of metal, lined or not with a rubber or a synthetic material.

In other variants the hantel may be provided with a device indicating its weight. This device may be mounted on the handle and may comprise either a graduated disc displaceble angularly with respect to a fixed mark, or a movable index displacable with respect to a fixed graduation. Each time the user modifies the weight of the hantel, he indicates with the aid of this device the new weight of the hantel.

Specifically, FIG. 2 shows an embodiment of index and graduation, in which a movable index 12 is rotatable relative to a fixed graduation 13; while FIG. 3 shows an embodiment in which a graduated disc 14 is displaceable angularly with respect to a fixed index 15.

What I claim is:

1. A hantel comprising a handle and at least two hollow bodies removably connected to each end of the handle, and a male coupling member interengaged in a female coupling member between the handle and each said hollow body connected to the handle, said coupling members being on said handle and said hollow bodies, each said hollow body connected to the handle having a coupling member thereon corresponding to the coupling member carried by the handle but on the side of the hollow body opposite the handle, thereby to permit the connection together of two said hollow bodies at the same end of the handle, each said hollow body having a filling opening closed by a plug, the plug closing one said coupling member of the hollow body.

2. A hantel as claimed in claim 1, in which the hollow bodies are plastic and the handle is of a material harder than the material of the hollow body.

3. A hantel as claimed in claim 1, in which the coupling between the handle and the hollow body is a threaded coupling.

4. A hantel as claimed in claim 1, and a display device on the handle of the weight of the hantel, said display device comprising a graduation and an index selectively registrable with the graduation.

5. A hantel as claimed in claim 4, in which the graduation is carried by the handle and the index is slidably mounted on the handle in order to be displaceable with respect to the graduation.

6. A hantel as claimed in claim 4, said graduation being carried by a disc that pivots on the handle and is displaceable relative to an index comprising a fixed mark on the handle.

* * * * *

UNITED STATES PATENT AND TRADEMARK OFFICE

CERTIFICATE OF CORRECTION

PATENT NO. : 4,076,236

DATED : Feb. 28, 1978

INVENTOR(S) : Stefan Ionel BAROI

It is certified that error appears in the above-identified patent and that said Letters Patent are hereby corrected as shown below:

Item 76, change the name of the inventor from "Stefan Ionel" to --Stefan Ionel Baroi--.

Signed and Sealed this

*Eighth* Day of *August 1978*

[SEAL]

*Attest:*

RUTH C. MASON
*Attesting Officer*

DONALD W. BANNER
*Commissioner of Patents and Trademarks*